United States Patent [19]

Price

[11] 4,310,875

[45] Jan. 12, 1982

[54] UNIVERSALLY ADJUSTABLE LAMP FIXTURE

[75] Inventor: Edison A. Price, New York, N.Y.

[73] Assignee: Edison Price, Incorporated, New York, N.Y.

[21] Appl. No.: 49,360

[22] Filed: Jun. 18, 1979

[51] Int. Cl.[3] ..... F21V 21/26

[52] U.S. Cl. ..... 362/277; 362/427; 362/269; 362/287

[58] Field of Search ..... 362/418, 422, 424, 428, 362/427, 255, 256, 269, 271, 273, 274, 275, 277, 279, 280, 285, 287, 289

[56] References Cited

U.S. PATENT DOCUMENTS

| | | | |
|---|---|---|---|
| 1,550,204 | 8/1925 | Carleton | 362/428 |
| 2,428,105 | 9/1947 | Woodall | 362/280 |
| 2,530,360 | 11/1950 | Price | 362/255 |
| 2,623,989 | 12/1952 | Lehmann | 362/255 |
| 2,785,291 | 3/1957 | Bernstein | 362/255 |
| 3,040,993 | 6/1962 | Schultz | 362/269 |
| 3,041,447 | 6/1962 | Oranger | 362/280 |
| 3,168,988 | 2/1965 | Kula | 362/255 |
| 3,305,681 | 2/1967 | Green | 362/275 |
| 3,837,607 | 9/1974 | Hesse | 362/418 |
| 4,158,222 | 6/1979 | Cook | 362/269 |

FOREIGN PATENT DOCUMENTS

| | | | |
|---|---|---|---|
| 1026284 | 2/1953 | France | 362/274 |

*Primary Examiner*—Monroe H. Hayes

*Attorney, Agent, or Firm*—McAulay, Fields, Fisher, Goldstein & Nissen

[57] ABSTRACT

A universally adjustable lamp fixture includes a separate base plate, light shield and lens assembly. The shield and base plate are releasably connected together to permit the single base plate to be connected with shields having different shapes, depending on the use to which the lamp fixture is to be applied. The shield is rotatable with respect to the base plate which, when a non-symmetrical shield is used, provides control of the orientation of the light patterns. The lens assembly includes a rotatably mounted lens having an engaging socket formed therein to permit it to be rotated by a complementary formed key. This permits control of the light pattern even after the lens has become too hot to safely touch. Alternatively a lens assembly, which includes a gripping member, may be used to rotate the lens and shield simultaneously.

4 Claims, 9 Drawing Figures

FIG. 2
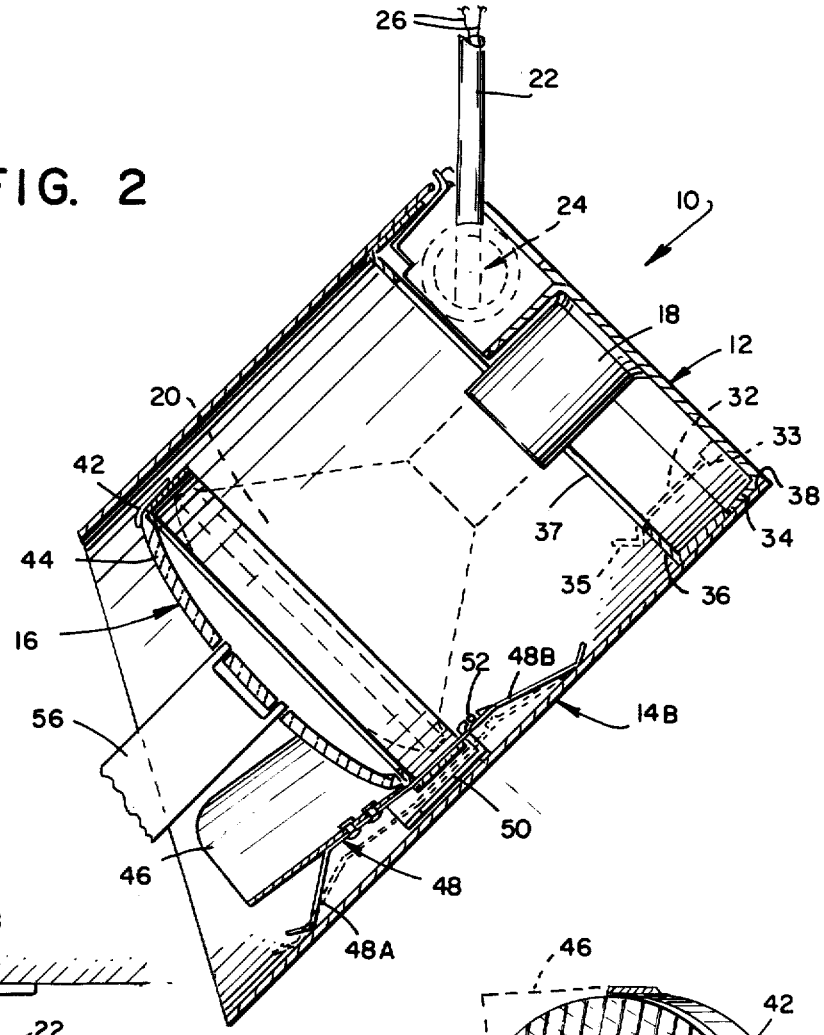
FIG. 8
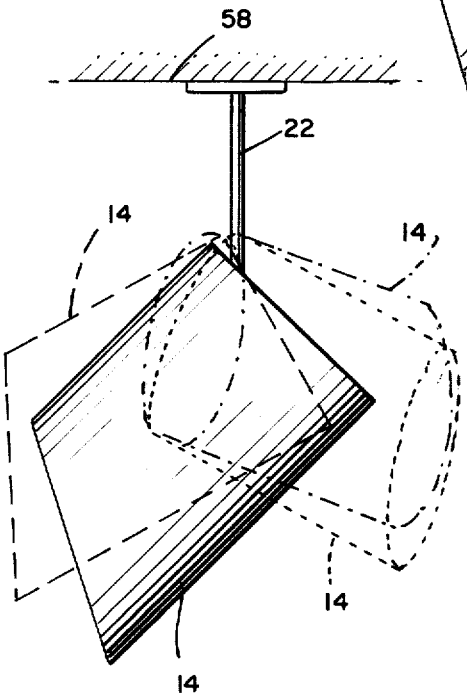
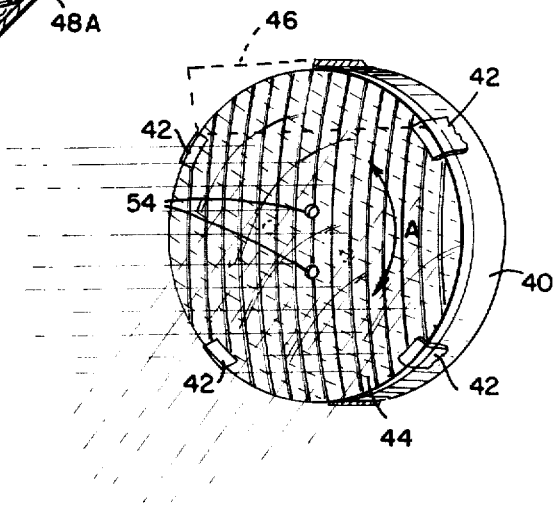
FIG. 5

FIG. 6
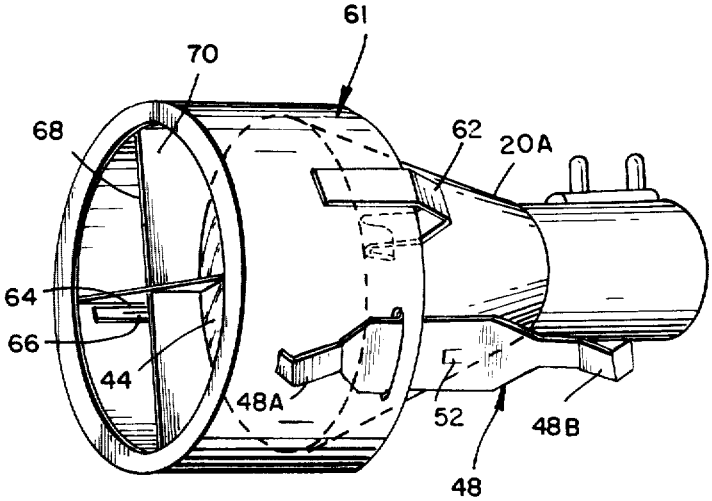
FIG. 7
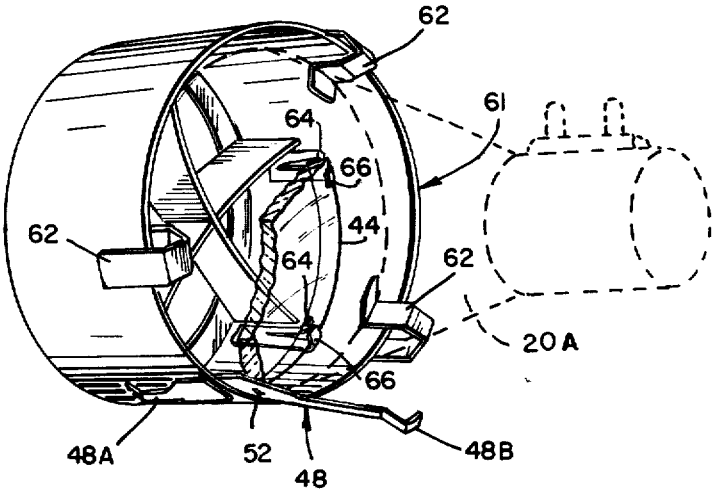
FIG. 7A
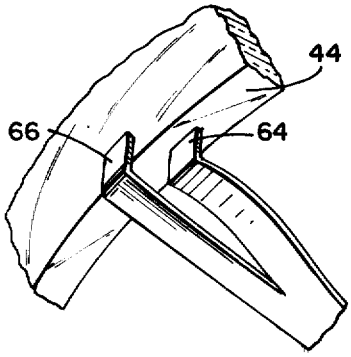
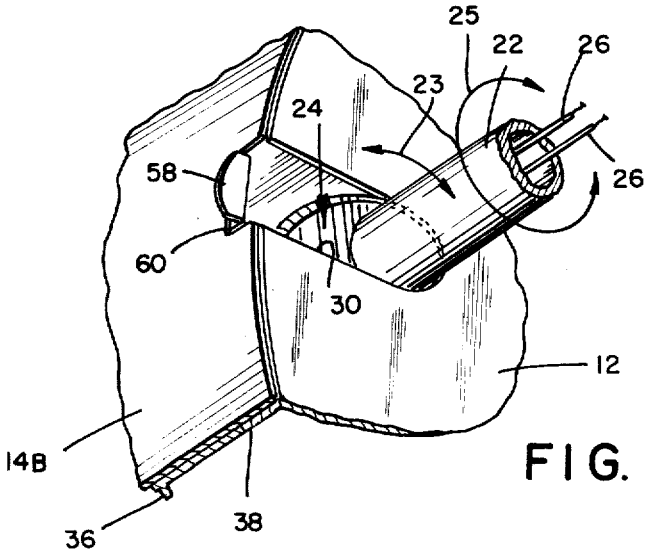
FIG. 4

UNIVERSALLY ADJUSTABLE LAMP FIXTURE

BACKGROUND OF THE INVENTION

The present invention relates generally to improvements in illumination devices and relates, more particularly, to an improved electrical lighting fixture of the universally angularly adjustable type.

Conventional electrical lighting fixtures, of the focussed light type commonly used in illuminating displays or specifically delineated areas thereof, are generally universally angularly adjustable. In general, these fixtures have a stem in the form of a tubular shank which not only supports the lamp assembly, but normally provides a conduit through which electrical wires pass from a track to a bulb socket. One end of the support stem is normally connected to the lamp base through a coupling which permits relative rotation therebetween, whereby the lamp fixture may be aimed as required. If the lamp fixture is to be a so-called "track-light" type of fixture, the other end of the support stem is normally fitted with an appropriate support and electrical interconnect means, as is required by the particular track lighting structure and the weight of the lamp fixture.

Focussed light type universally adjustable lamp fixtures, whether permanently affixed to the ceiling or wall or of the track-light type, have at least two different types of constructions depending on the object to be illuminated. If the lamp is to be used for wall lighting for example, a lamp fixture using an obliquely cut shield collar construction is normally employed. If a tight spot-light type of illumination is required, such as to illuminate a sculpture or other item on display, a lamp fixture with a shield collar formed as a complete cylinder, to collimate the light is normally employed. Thus, different lamp fixtures were required for different uses.

The lens normally employed on spot-light lamp fixtures is formed with generally parallel defraction grooves to produce a required light pattern. When the lamp fixture is rotated about the stem to aim it or adjust it for a particular area to be illuminated, it is often necessary to rotate the lens to align the parallel grooves with respect to the area being lit, to obtain the desired light pattern. Normally this is done after the fixture has been aimed, by having someone press his fingers gently against the lens and rotate it until the desired light pattern is attained. If the lamp has been turned on for any appreciable time the lens becomes hot and there is potential for injury to the person rotating the lens.

It is therefore an object of the present invention to provide a universally adjustable lamp fixture which may be used in either a tight spot - or a broader flood-light mode by interchanging an easily removed light shield.

It is a related object to provide a universally adjustable lamp fixture which can quickly and easily be aimed to produce a desired light pattern.

It is a further object of the invention to provide a universally adjustable lamp fixture whereby, after the lamp has been aimed, the lens can be adjusted with a minimum of danger of burning the hands to the person doing the adjustment, by providing an adjustment means avoiding the need for direct contact between the hand of the person doing the adjustment and the potentially hot lens.

BRIEF DESCRIPTION OF THE DISCLOSURE

A universally adjustable lamp fixture, according to the present invention, is formed with separate and releasably interconnected base plate, shield collar, and lens assembly elements.

The base plate is secured to a support stem, in the form of a tubular shank, by means of a swivel coupling whereby the lamp base may be swiveled and turned with respect to the support stem. The other end of the support stem may be adapted to be interengaged with a light-track, or to be secured to a wall or ceiling or other support structure, as required by the design and use of the lamp.

The shield collar is releasably connected to the base plate to permit interchanging various types of shield collars without the need to remove the base plate from its support. In this way, one need only keep a supply of various shapes or sizes of shield collars which can be attached to the base plate depending on the illumination requirements. This reduces the cost and storage requirements of the fixtures of the present invention.

The separate lens assembly may be generally conventional and, as usual, is adapted to be releasably secured to the end of the shield collar. In one embodiment the lens itself is rotatably mounted on the lens assembly. Where a usual fluted lens is used, rotation of the lens to adjust its pattern with respect to the area being illuminated, after the lamp assembly has been adjusted, is accomplished using a key. The lens has a socket with which an appropriate key may mate. It has been found that two holes, spaced apart from each other, drilled through the lens, can be used as a socket without noticeably affecting the light pattern. A simple two prong key can be used to rotate the lens without the need for direct contact between the hand of the person focussing the lens and the lens itself. In a second embodiment, rotation of the lens and the shield collar is accomplished by use of a gripping structure mounted on the lens holder.

In the preferred embodiment, the shield collar is also rotatable with respect to the base plate. This provides an additional adjustment of the light beam with respect to the area being lit, after the lamp fixture has been generally aimed.

BRIEF DESCRIPTION OF THE DRAWINGS

In the drawings:

FIG. 2 is a sectional view of the assembled lamp fixture, with the flood-type light shield in place;

FIG. 4 is a detailed view of the lock assembly between the base plate and shield;

FIG. 5 is a perspective view of the lens assembly;

FIG. 6 is a front perspective view of a second embodiment of the lens assembly showing a gripping baffle structure;

FIG. 7 is a rear perspective view of the embodiment of FIG. 6, with the bulb in phantom and the lens partially broken away to show the assembly;

FIG. 7A is an enlarged partial view showing the support of the edge of a lens; and FIG. 8 is a side elevational view of the fixture of the present invention.

DESCRIPTION OF THE PREFERRED EMBODIMENTS

Figure 1:
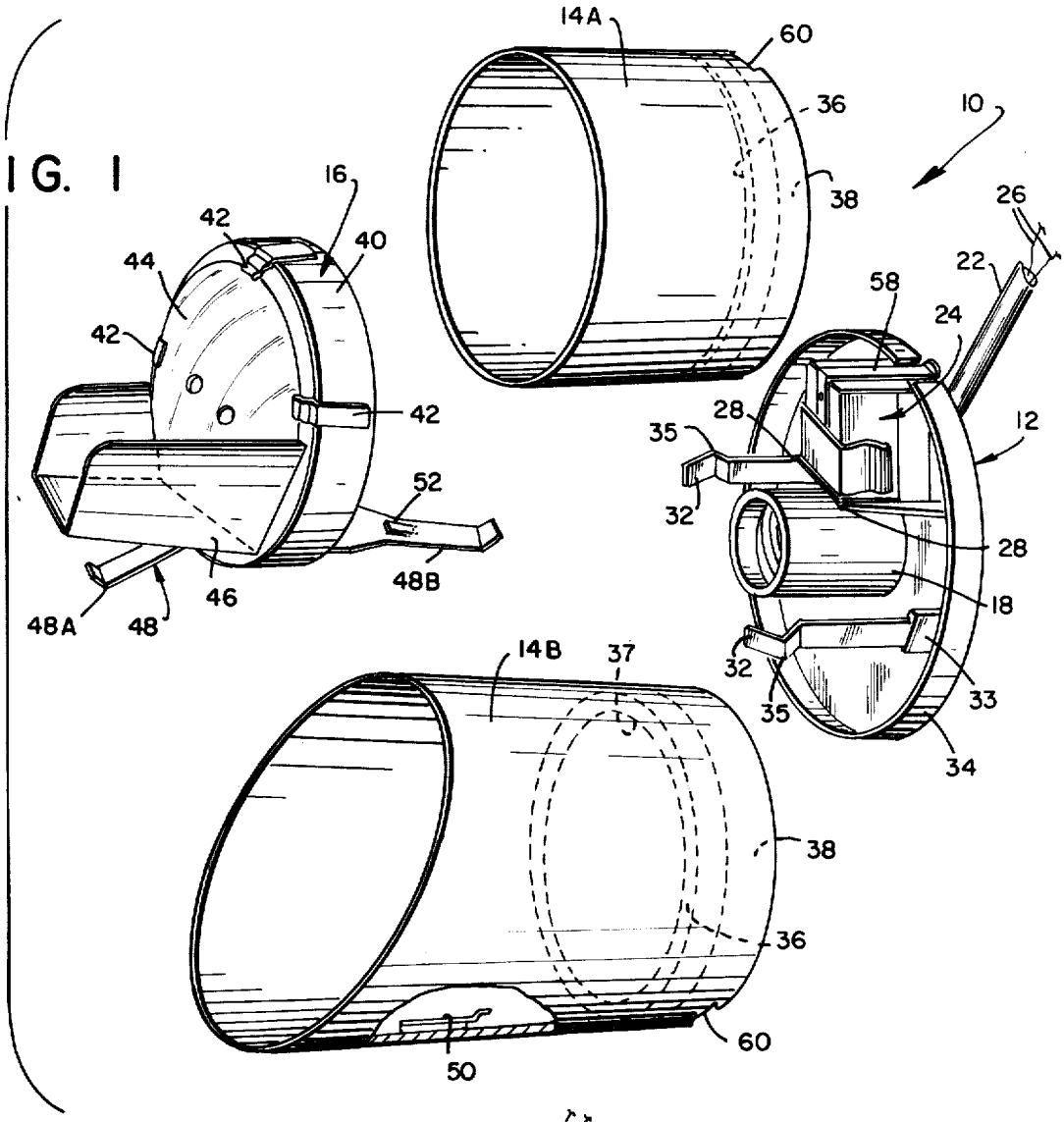
FIG. 1 is an exploded view of a universally adjustable lamp fixture constructed according to the present invention showing two light shield collars.
Figure 3:
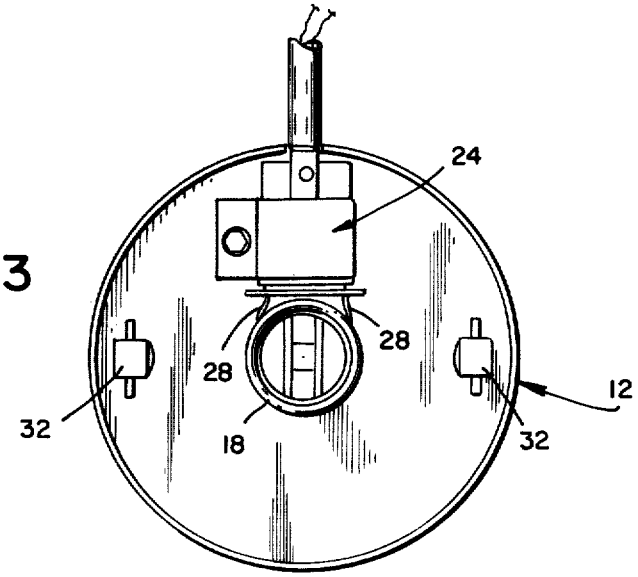
FIG. 3 is a front elevational view of the base plate.

With reference especially to FIGS. 1 and 2, a universally adjustable lamp fixture 10 constructed according to the present invention has a base plate 12, a light shield collar 14A or 14B and a lens assembly 16.

The base plate 12 has mounted thereon, a lamp socket 18 which receives a lamp 20 (FIG. 2). Because of the large amount of heat generated, it is preferable that the socket 18 be formed of porcelain or a similar material to protect the electrical connection therein. The base plate 12 is secured to a support stem 22 by a swivel coupling 24 (which is not shown in detail in the drawings). Support stem 22 is preferably in the form of a hollow shank through which electric wires 26, 26 gain access to the interior of the swivel coupling 24. As shown in FIG. 4, a slot 30 formed in the base plate 12, permits swivel movement of the base plate 12 with respect to the support stem 22 in the direction indicated by double-headed arrow 23. (See also FIG. 8). In addition, the whole unit can rotate around support stem 22 as shown by double-headed arrow 25 (FIG. 4).

In accordance with the present invention, means is provided to releasably connect the light shield with the base plate while permitting relative rotation therebetween to facilitate directing the light pattern to blanket a selected area. More specifically, a pair of diametrically opposed forwardly extending spring clips 32 are provided on base plate 12. The clips are secured by clamps 33 to the base plate. A peripheral flange 34 surrounds the base plate. The clips are bent outwardly at 35 adjacent the free ends.

As illustrated in FIG. 1, there are generally two different types of shield collars: a spot-light shield 14A and a broader flood-light shield 14B. The main difference between these types of shield collars 14A versus 14B, is that the flood type of collar 14B has a beveled end opening to form an oval opening, as viewed from the side while the spot-light type of collar 14A has a cylindrical wall which is substantially the same length completely around the circumference thereof, forming a circular opening. As will be readily realized, the spot light shield 14A, depending on the total length of the collar, will tend to collimate the light, while the flood light type of collar 14B will permit a wider area to be lit on one side while shielding the light from a viewer on the other, longer, side. Although two different types of shields have been disclosed, it is to be noted that this is for illustrative purposes only and is not to be interpreted as a limitation on the present invention. That is differently designed shields may be used depending on the light pattern that is desired. Of greater importance is the fact that any one of the shields may be quickly and easily connected to the base plate 12 thereby eliminating the necessity for stocking entire fixtures. That is, only the interchangeable light shields need be stocked in quantity. Moreover, one type of shield may easily be substituted for another without dismantling the entire fixture.

Each of the light shields is provided with an internal ring 36 spaced inwardly from the rear end. The ring has a central opening 37 that receives the clips 32 therethrough. More specifically, when a light shield such as 14B is connected to the base plate 12, the shield is moved downwardly on the base plate until the end of the clips 32 enter the opening 37. Further movement toward the base plate causes the clips to cam inwardly on the wall of the ring 36 until the bent ends 35 clear the opening 37, at which point the clips will spring back to their normal position with the bent ends of the clips overlying the ring 36 (FIG. 2) to connect together the shield and base plate. The flange 34 engages the inner wall of the shield in a sliding contact to aid in centering the shield on the base plate. The elements are sized so that the forward edge of the flange 34 engages the ring 36 to limit further movement when the clips 32 are in overlying relationship to the ring 36.

When it is desired to disconnect the base plate 12 from a light shield, the clips 32 are moved toward each other by hand until the bent portions clear the ring 36 and the plate and shield are simply moved apart.

It will be apparent that since the only connection between plate and shield are the clips 32 abutting against the ring 36, the shield may easily be rotated relative to the plate. Thus, for a shield of the type designated by character 14B, the light pattern may be directed to different areas by rotating the shield. A spring tab 58 is mounted on the base plate 12, as shown in FIGS. 1 and 4, and is adapted to be received in notch 60, formed in the edge of shield 14A, 14B. As shown in FIG. 4, the tab 58 snaps into notch 60 to lock the shield in a single normal or home position on the base plate 12. If it becomes desireable to rotate the shield with respect to base plate 12, tab 58 need only be depressed out of engagement with notch 60 and the shield rotated as desired.

The embodiment illustrated in FIGS. 1 and 5, comprises a lens holder 40 and includes circumferentially spaced lens retaining clips 42 which overlie and retain the lens in the holder 40. The lens retaining clips 42 permit rotation of lens 44 with respect to lens holder 40.

A light reflector 46 and spring retaining clip 48 are also mounted on the lens holder 40. The lower portion 48B of retaining clip 48 extends into a retaining clip socket 50 mounted on the inner wall of shield collar 14B. Although not shown in the drawings, a similar clip is mounted on the inner wall of spot collar 14A. The interengagement of retaining clip 48 and retaining clip socket 50 removably secures the lens assembly 16 to the shield 14A, 14B, and supports the lens assembly 16 in proper spaced relation from the bulb 20 (FIG. 1 and FIG. 2). A clip detent 52 serves to lock the clip against the edge of clip retaining socket 50 until lower portion 48B is flexed to permit removal thereof.

The forward portion 48A of retaining clip 48 abuts the inner wall of shield 14A, 14B, in a spring bias to further support the lens 16 in proper spaced relationship with respect to the rest of the fixture. As shown in FIG. 5, the lens 44 is fluted to obtain an oval or otherwise asymetric light pattern.

Because the light reflector 46 is not required for spotlight use and because spot collar 14A is usually not long enough to contain reflector 46, a second embodiment lens holder assembly 61, without a reflector 46, is normally preferred for use with spot collar 14A.

The reflector lens holder 61, as illustrated in FIGS. 6 and 7, is provided with a retaining clip 48, as was the lens holder 40, and may therefore be used interchangeably with lens holder 40 in flood shield 14B.

A lens 44 (partially shown in FIG. 7) is supported in lens holder 61 by paired support clips 64, 66. One of the paired support clips 64 is shorter and bent away from the side of lens holder 61; while the other support clip 66 extends further back. As can be seen by comparison of FIGS. 7 and 7A, the lens is supported between long clips 66 and the curved rear portion of baffle 68. The shorter clips 64 provide a spring bias against the edge of the lens to hold and center the lens in the holder.

The baffle structure 68 is in the form of crossed arms 70, 72. This baffle 68 provides a convenient means to rotate the lens assembly 61 without the need to touch the lens itself. One need only reach up between crossed arms 70, 72 and turn. This will cause the lens holder 61 and light shield 14A, 14B to rotate and produce varying coverage patterns for adjustment as desired. The main purpose of structure 68 is as a louver or baffle to remove glare from the beam.

Also illustrated on the lens holder 61 are bulb support clips 62. These are important in holding and aligning a bulb 20A in the lamp fixture when a side plug connection (FIGS. 6 and 7) is used in the base instead of the socket 18 shown in FIG. 1. These electrical connection arrangements are normally used when it is necessary to limit the size of the fixture. They do not support the bulb. Because the connection does no support and align the bulb, clips 62 are provided for that purpose, as shown in FIGS. 6 and 7.

It may be desireable, especially when using a fluted lens 44 in a non-symmetrical light shield such as flood shield 40, to rotate lens 44 with respect to light shield 40 to obtain a specific coverage pattern. This is because the fluted lens 44 projects light in a varying pattern depending on its rotational orientation. Provision for relative rotation between lens holder 40 and flood-light shield 14B is therefor advantageous. This is accomplished by forming a socket in the lens 40 for engagement with a key whereby rotation of the key will cause the lens 44 to rotate in lens holder 40.

FIG. 5 shows, partially in phantom, two rotational positions for fluted lens 44 wherein the light passing therethrough is projected at a slightly different angle and with a slightly different pattern. Double-headed arrow A indicates the direction of relative rotation of lens 44 with respect to lens holder 40. As is illustrated in FIGS. 2 and 5, a socket in the form of two spaced apart openings 54, 54 is formed in the lens 44. A key 56 (FIG. 2) having prongs adapted to be received in the openings 54 in lens 44 is provided to permit rotation of lens 44. The openings 54 do not noticeably affect the light pattern formed by the lens 44. The length of pronged key 56 may be any convenient length to avoid accidental contact between the fingers of the person using the key 56 and the lens 44.

The reflector 46, shown in FIGS. 1 and 2, is only useful when shield 14B is used, to further reflect light in a spreading pattern through the open side of shield 14B. However, as noted above, the reflector 46 is usually too long to fit inside the spot shield 14A and therefor a shorter, reflectorless lens holder 61 is preferable for use with spot shield 14A. If desired, lens holder 61 may be used with flood shield 14B thereby requiring only one type of lens assembly 61 for either type of shield.

The embodiment shown in FIG. 8 is permanently mounted to a ceiling 58. However, as noted above, the light assembly of the present invention is also particularly suitable for use with track lighting mounted on the wall or depending from the ceiling of a room as required.

In practice, the desired shield 14A, 14B is connected to the base plate 12 and the lens assembly 16 or lens holder 60 with lens supported therein is fitted. The fixture is mounted on its support structure and aimed toward the area to be illuminated. The shield 14A, 14B may then be rotated relative to plate 12 to obtain the desired light pattern. With lens assembly 12, key 56 may be inserted into lens 44 to rotate the same while the lamp is energized so the operator can visually observe the different light patterns until the desired pattern is obtained. With lens holder 61, the shield and holder 61 can be rotated, as required, by means of gripping structure 68.

Accordingly, a fixture has been disclosed that permits easy interchangeability between light shields while providing control over the light pattern which the fixture is furnishings.

While a preferred embodiment of the invention has been disclosed herein it will be obvious that numerous omissions, changes and additions may be made in such embodiment without departing from the spirit and scope of the present invention. For example, engagement clips 32 are disclosed as being mounted on base plate 12, and engagement ring 36 is disclosed as being mounted on light shield 14A or 14B. These can easily be reversed without departing from the spirit of the present invention.

What is claimed is:

1. A universally adjustable lamp fixture comprising:

a base plate for supporting a lamp;

a lamp shield for directing light from the lamp;

a lens assembly including a lens for focussing and modifying the distribution of light from the lamp;

complementary formed releasable interconnect means on said base plate and said shield for releasably connecting together said shield and said base plate, said interconnect means comprising a forwardly extending peripheral rim on said base plate forming a socket to receive said lamp shield therein, at least a pair of spring biased clip on said base plate extending forwardly therefrom, said clips having outwardly extending bends adjacent their respective end, and an engagement ring circumferentially disposed on and extending inwardly from the inner surface of said shield, said ring defining an opening having a radius smaller than the distance between the outer bends of said clips whereby said outer bends of said clips overlie and abut said ring to retain said lamp shield on said base and permit relative rotation therebetween, said clips being adapted to be moved toward each other until said outer bends clear said ring to permit separation of said lamp shield and said base plate;

a spring tab on said base plate;

and a notch in said lamp shield adapted to releasably receive said tab therein to lock said light shield in a desired orientation and prevent relative rotation between said light shield and said base plate.

2. The lamp fixture of claim 1 wherein said lens assembly further comprises a gripping structure for manually gripping said lens assembly for rotation of said lens assembly and said shield with respect to said base plate.

3. The lamp fixture of claim 1, wherein said lens assembly includes a lens rotatably mounted therein, further comprising:

socket means defined in said lens and being operable to interengage with a key whereby rotation of the key will rotate said lens.

4. The lamp fixture of claim 3 wherein said socket comprises two centrally disposed openings formed through said lens.

* * * * *